US006958457B2

(12) United States Patent
Murphy

(10) Patent No.: US 6,958,457 B2
(45) Date of Patent: Oct. 25, 2005

(54) SWITCH LEVER SYSTEMS FOR PHYSICALLY CHALLENGED INDIVIDUALS

(76) Inventor: Kevin Murphy, 97 Forrest St., Plaistow, NH (US) 03865

( * ) Notice: Subject to any disclaimer, the term of this patent is extended or adjusted under 35 U.S.C. 154(b) by 0 days.

(21) Appl. No.: 10/782,049

(22) Filed: Feb. 19, 2004

(65) Prior Publication Data

US 2005/0183939 A1 Aug. 25, 2005

(51) Int. Cl.[7] ..... H01H 9/00

(52) U.S. Cl. ..... 200/52 R; 200/332; 200/329; 200/335

(58) Field of Search ..... 200/4, 17 R, 18, 200/52 R, 61.85, 553, 335, 329–332; 414/921

(56) References Cited

U.S. PATENT DOCUMENTS 4,045,630 A * 8/1977 McCarthy et al. ..... 200/52 R
4,492,128 A * 1/1985 Heidelberger et al. . 74/471 XY
5,113,179 A * 5/1992 Scott-Jackson et al. ..... 345/161
5,473,325 A * 12/1995 McAlindon ..... 341/20
6,684,969 B1 * 2/2004 Flowers et al. ..... 180/65.1

* cited by examiner

*Primary Examiner*—Michael A. Friedhofer
(74) *Attorney, Agent, or Firm*—Bourque & Associates

(57) ABSTRACT

A system for assisting physically challenged users in operating at least one device comprising a frame, at least one user operable switch lever mounted to the frame and having a generally large activation region, and at least one switch operatively connected between the at least one switch lever and the at least one device, and for energizing the at least one device. A tensioning device applies tension to the at least one switch lever, for holding the at least one switch lever under tension in a first position, but allowing the at least one switch lever to be moved by the user into a second position to energize the at least one device upon the user applying a force to the at least one switch lever in an opposite direction of the tension that exceeds the tension applied by the tensioning device, and for returning the at least one switch lever to the first position. Also included is a switch range adjuster for adjusting the at least one switch lever's range of motion between the first position and the second position.

20 Claims, 4 Drawing Sheets

SWITCH LEVER SYSTEMS FOR PHYSICALLY CHALLENGED INDIVIDUALS

TECHNICAL FIELD OF THE INVENTION

The present invention relates to switch lever systems and more particularly, to switch lever systems for physically challenged individuals.

DESCRIPTION OF THE RELATED ART

Physically challenged individuals may have limited sight and cognitive abilities. Because of their limited cognitive abilities, these individuals may have difficulty learning the cause and effect of activating a device because the effort to trigger an action may be too difficult leading to failure. Based on the foregoing, it can be appreciated that a need exists for a system for teaching a physically challenged person, who may not have previously activated a switch, button, or other triggering device, the cause and effect of operating said switch, button, or other triggering device. Specifically, a need exists for a system that is easily learned, mitigates failure, encourages education, is a transition to more complex arrangements of switch systems, and is a diagnostic device.

Further, physically challenged individuals often have a difficult time utilizing various household devices, and/or toys or other amusement devices. For example, for individuals who are unable to accurately utilize their hands, it may be impossible or at the least very difficult for them to turn on a television or radio, or activate a toy. Often times, the caregiver of a physically challenged individual will turn the television on and position the person in front of the television. A significant disadvantage with this arrangement is that the physically challenged individual will not be able to change the channel.

Based on the foregoing, it can be appreciated that a need exists for a system that allows a physically challenged person to activate various everyday devices. A system that could be adapted to allow physically challenged individuals the ability to control various devices would be a welcome advance. It is believed that the disclosure provided herein presents such an improved technology.

Often times, a person may be temporarily disabled because of an accident, injury, or illness. For example, a stroke or other brain injury may impair a person's ability to coordinate his/her movement. In those cases, rehabilitation is prescribed to attempt to restore the person's physical movement back to normal or as close to normal as possible.

Based on the foregoing, it can be appreciated that a need exists for a system that encourages temporarily physically or mentally challenged individuals to increase their range of motion and strength in their impaired extremity(ies). A system having switch levers linked to a device for controlling said device could be adapted to encourage a physically and mentally challenged individual to increase their range of motion and strength in the impaired extremity(ies).

SUMMARY OF THE INVENTION

The present invention features a switch lever system for teaching a physically challenged individual how to operate a switch, button, or other triggering device, and the cause and effect of operating the switch, button, or other triggering device to a person having limited cognitive abilities. The system mitigates failure and encourages education because of its simplistic and easy operation. Further, the system improves the mobility, strength, and range of motion of the user.

The present invention also features a switch lever system that can be used as a diagnostic tool. The physical, occupational, or language therapist, or special education instructor (hereinafter "therapist") may use the system when working with physically challenged individuals, who may have never operated a switch, button, or other trigger device. The therapist may initially teach the user the cause and effect of operating the system. The system is easily learned because failure is minimized. Thereafter, the therapist may adjust the range of motion and force required to operate the switches, thereby encouraging the user to use more mobility and strength to operate the system. Significantly, the system can be rearranged into more complex systems for transitioning the user to a more self-controllable environment. For example, the system may initially be arranged around the user on a frame and then rearranged to the user's wheelchair, wherein the user may control movement of the wheelchair. The system serves as a bridge or transitioning device to more complex tasks.

The present invention also features a plurality of switches, wherein each switch has a range of motion and force required for activation that are independently adjusted or controlled. For example, a person may have limited movement in their left arm but considerable movement in their right leg. The system allows the therapist or caregiver the ability to adjust each switch to encourage or exploit maximum movement and force from each extremity of the user.

The present invention features a switch lever system for improving the day-to-day activities of a physically challenged individual by providing a way in which a physically challenged individual can operate or activate certain devices. The switch lever system may also be used to rehabilitate and teach stroke victims and other individuals who suffer physical and mental disabilities.

Specifically, the present invention includes a frame, at least one user operable switch lever having a generally large activation region, and operatively mounted to the frame, and at least one switch operatively connected between the at least one switch lever and the at least one device, for energizing the at least one device. The invention also includes a tensioning device, for applying tension to the at least one switch lever, and for holding the at least one switch lever under tension in a first position but allowing the at least one switch lever to be moved by the user into a second position to energize the at least one device upon the user applying a force to the at least one switch lever in an opposite direction of the tension that exceeds the tension applied by the tensioning device. Also included is means for returning the at least one switch lever to the second position, and means for adjusting the at least one switch lever's range of motion between the first position and the second position.

BRIEF DESCRIPTION OF THE DRAWINGS

These and other features and advantages of the present invention will be better understood by reading the following detailed description, taken together with the drawing wherein.

DETAILED DESCRIPTION OF THE PREFERRED EMBODIMENTS

Figure 1:
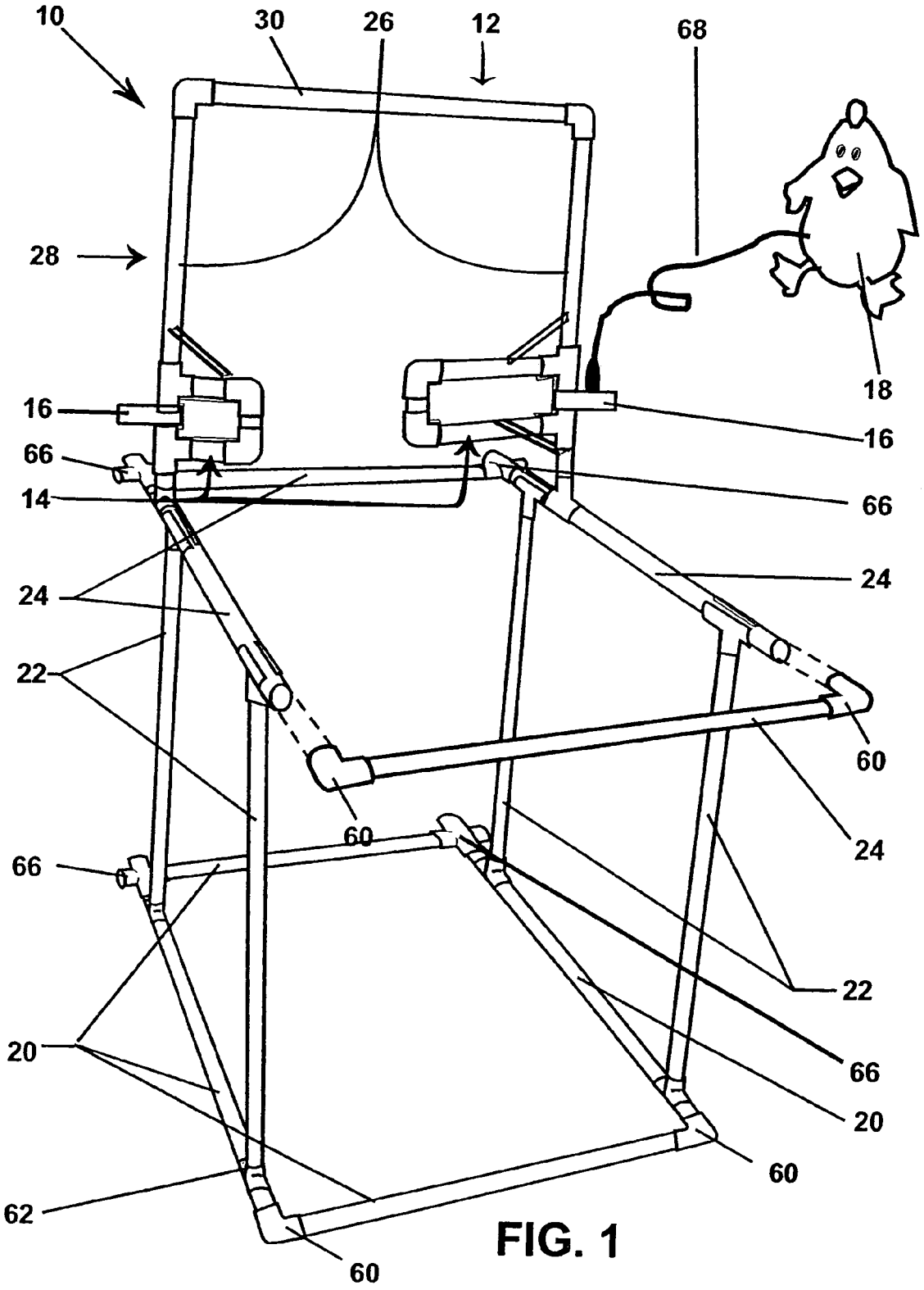
FIG. 1 is a perspective view of a switch lever system for physically challenged individuals according to the present invention.

With reference now to the drawings wherein like reference numerals designate corresponding parts throughout the several views, a switch lever system 10, FIG. 1, for physically challenged individuals improves the day-to-day activities of a physically challenged individual by providing a way in which a physically challenged individual can operate or activate certain devices 18. The switch lever system 10 may also be used to rehabilitate stroke victims and other individuals who suffer physical and mental disabilities.

The switch lever system 10 has a frame 12, at least one switch lever 14, at least one switch 16, and at least one device 18. The switch lever 14 is placed in close proximity to at least one extremity of a user. The goal is for the user to move the switch lever 14 thereby activating the switch 16. The switch 16 is operatively connected to at least one device 18. Upon activation of the at least one switch 16, the device 18 is activated.

The frame 12 supports the switch lever 14 which can be activated by at least one extremity of the user such as the user's arm, hands, legs, feet, elbows and knees. The frame 12 may be designed around a wheelchair, bed, chair, or around the user. For illustration purposes, FIG. 1 shows the frame 12 designed for accommodating a wheelchair; however, the frame 12 may be designed to accommodate any number of arrangements such as around a bed, chair, or around the user. In the wheelchair embodiment, the frame 12 is made out of PVC tubing. The frame 12 typically has four bottom members 20, wherein the four bottom members 20 extend horizontally and are attached to each other by means of elbow connectors 60 and cross members 66. The cross members 66 are preferably placed at a front portion of the frame 12 for stability and to accept additional members to construct additional items, such as a table or television stand. At least one of the four bottom members 20 may be removable proximate one of the elbow connectors 60 to facilitate a wheelchair, rolling chair or other movable device to be moved into position in the center of the frame 12.

Four vertically extending members 22 extend upward from the bottom members 20 and are connected to three middle members 24. The vertically extending members 22 are connected to the bottom members 20 and the middle members 24 utilizing "T" connectors 62. The middle members 24 are connected to each other and form a U-shape. A front end 28 of the switch lever system 10 has two upright portions 26 connected to the middle members 24 at a first end and to a top member 30 at a second end. The two upright portions 26 are connected to the middle members 24 by means of the T connectors 62 and to the top member 30 by means of the elbow connectors 60. At least one of the four middle members 24 may be removable proximate one of the elbow connectors 60 to facilitate a wheelchair, rolling chair or other movable device to be moved into position in the center of the frame 12 and to provide added security within the confines of the frame 12.

The switch lever 14 may be operatively mounted to the bottom members 20, vertically extending members 22, the middle members 24, the uprights 26, and/or the top member 30. In FIG. 1, a number of switch levers 14 are shown attached to the uprights 26; however, the switch lever 14 may be assembled to any of the components making up the frame 12. The location of the switch lever 14 will depend on which extremity or extremities are to be used in moving the switch lever 14 to activate the switch 16. The switch lever 14 may be movably mounted to different locations of the frame 12.

Figure 2:
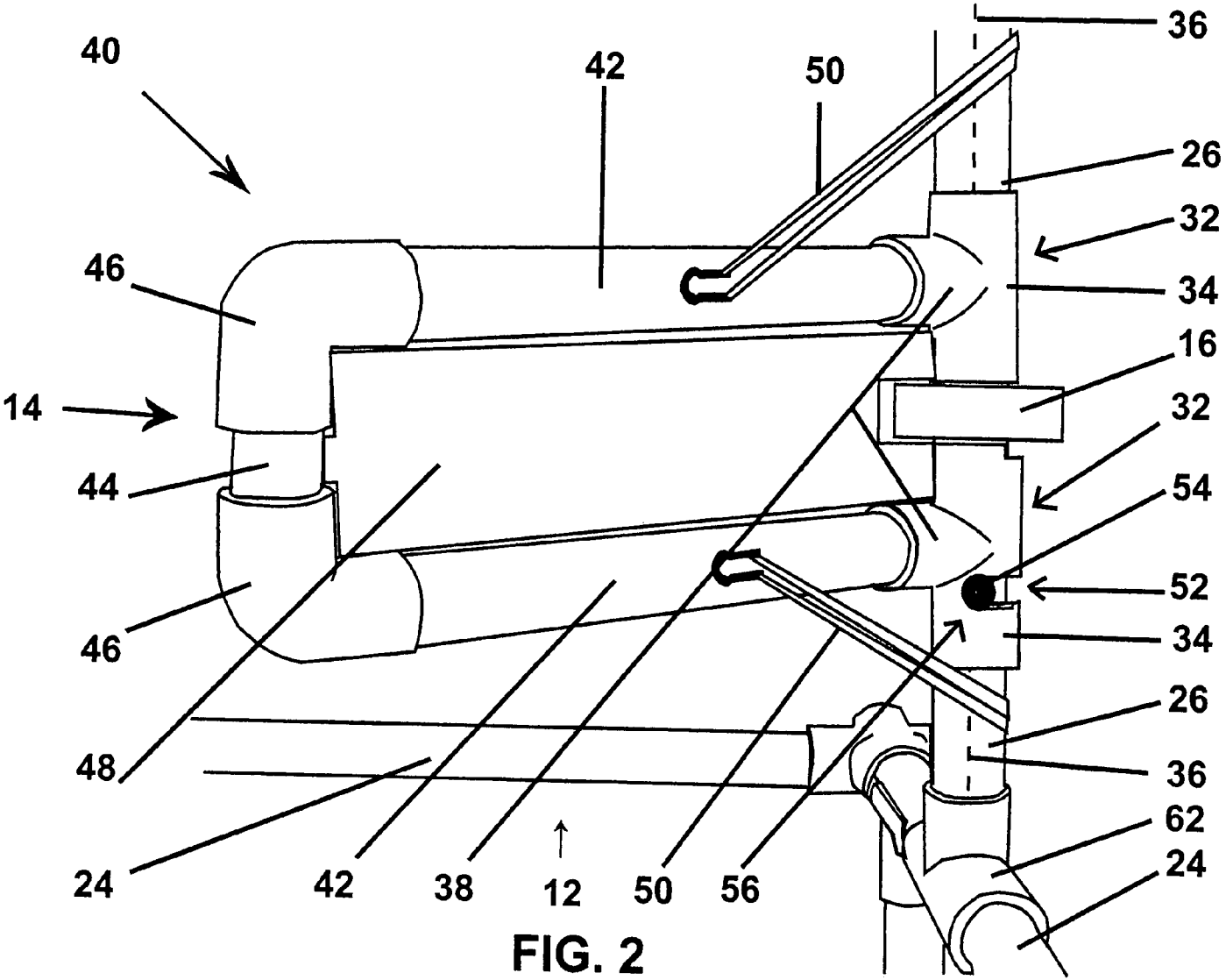
FIG. 2 is a front view of a switch lever of the switch lever system shown in FIG. 1 and according to the present invention.

FIG. 2 shows the switch lever 14 operatively mounted to the frame 12. The switch lever 14 has two rotatable "T" members 32. The rotatable T members 32 have first portions 34 that pivot about an axis 36, and second portions 38 that are generally perpendicular to the first portions 34. In the preferred embodiment, a center portion 40 has two horizontal supports 42 connected to the second portions 38 of the rotatable T members 32 at first ends, and to a center member 44 by means of switch elbows 46. A center paddle 48 is operatively connected to the center portion 40. In the preferred embodiment, the vertical member 26 is friction fitted into the "T" member 32 below and the elbow 60 above. For example, the switch lever 14 may be rotated from a parallel position to a perpendicular position with respect to the user's chest.

The switch lever 14 has a range of motion that is variable and controllable about the axis 36. The switch lever 14 is placed under tension, and the tension is adjustable and controllable. The switch lever 14 is placed under tension by tension members 50 that are operatively attached to the horizontal supports 42 and the uprights 26. The tension members 50 control the tension of the switch lever 14. In the preferred embodiment, the tension members 50 are elastic bands. There are various types of rubber bands that can be used with the switch lever system 10, and one skilled in the art will know that the selection of a certain dimensioned elastic bands or any other device which serves as a tension member will dictate the tension placed on the switch lever 14. In an alternative embodiment, multiple rubber bands may be used to increase the tension. In alternative embodiments, springs or other types of tensioning devices may be used as the tension members 50.

The range of motion of the switch lever 14 is set by a cutout 52 in the rotatable T members 32 and a set pin 54 operatively attached to the uprights 26. The longer the cutout 52 extends along the circumference of the rotatable T members 32; the greater the range of motion available. In contrast, the shorter the length of the cutout 52 along the circumference of the rotatable T members 32; the smaller the range of motion of the switch lever 14.

The tension members 50 hold the switch lever 14 in a first position, wherein a first end 56 of the cutout 52 in the rotatable T members 32 contacts the set pin 54. The tension members 50 hold the switch lever 14 in the first position when the switch lever 14 is not being pushed or urged.

When a force greater than the tension placed on the switch lever 14 by the tension members 50 is placed on the switch lever 14 in the opposite direction of the tension, the rotatable T members 32 will rotate about the axis 36, such that the first end 56 of the cutout 52 moves away from the set pin 54. When the rotatable T members 32 rotate such that the cutout 52 moves away from the set pin 54, the switch lever 14 moves into a second position, wherein the device 18 is activated using the switch 16.

Figure 3:
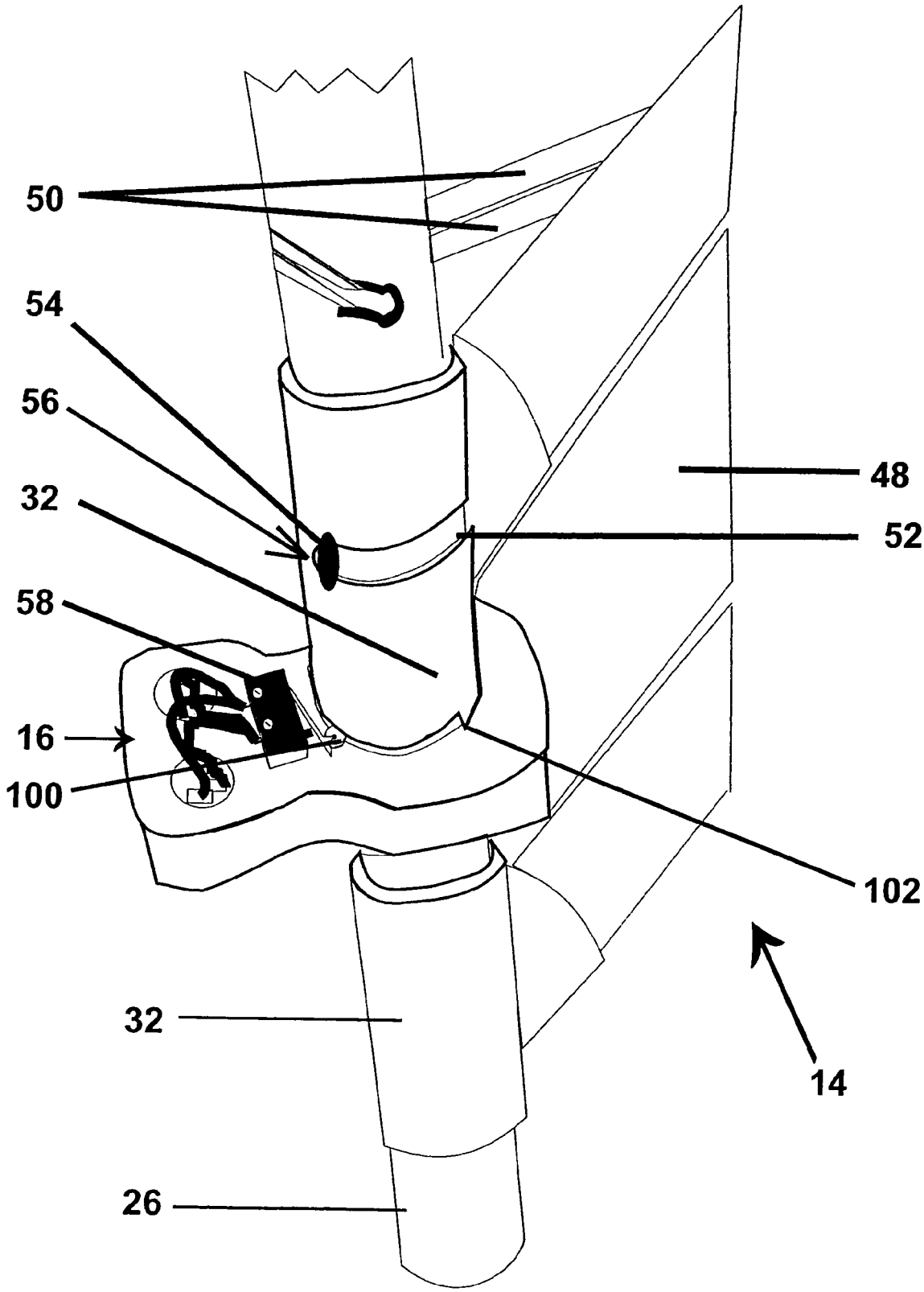
FIG. 3 is a plane view of a switch of the switch lever system shown in FIG. 1 and according to the present invention.

The switch 16 is operatively attached to the switch lever 14 as shown in FIG. 3. The switch 16 has an activation switch 100, wherein when the switch lever 14 is rotated a lever 102 moves toward the activation switch 100. When the lever 102 contacts the activation switch 100, the switch 16 is activated. In the preferred embodiment, the range of motion may be controlled by the positioning of the activation switch 100 with respect to the lever 102; however, in alternative embodiments, other switches may be substituted. In the preferred embodiment, the switch 16 is friction mounted to the uprights 26. In an alternative embodiment, a clamp may be used to mount the switch 16 and may be loosened or tightened as required. When the switch lever 14 rotates about the axis 36 into the second position, the lever 102 contacts the activation switch 100 of the switch 16, thereby activating a trigger mechanism 58.

The switch 16 is electrically and operatively connected to the device 18. The device 18 may be a toy, television remote control, television, infrared transmitter, fan, or any other type of device. When the switch lever 14 activates the switch 16 by means of the trigger mechanism 58, the switch 16 activates the device 18. In the preferred embodiment, the switch 16 may be operatively connected to the device 18 by a wire 68. The wire 68 has a first end 72 with a mono audio jack mounted thereto that functions as an electrical connector. The first end 72 is received by an electrical receiving portion 70 operatively connected to the switch 16. A second end of the wire 68 is operatively connected to the device 18.

Figure 4:
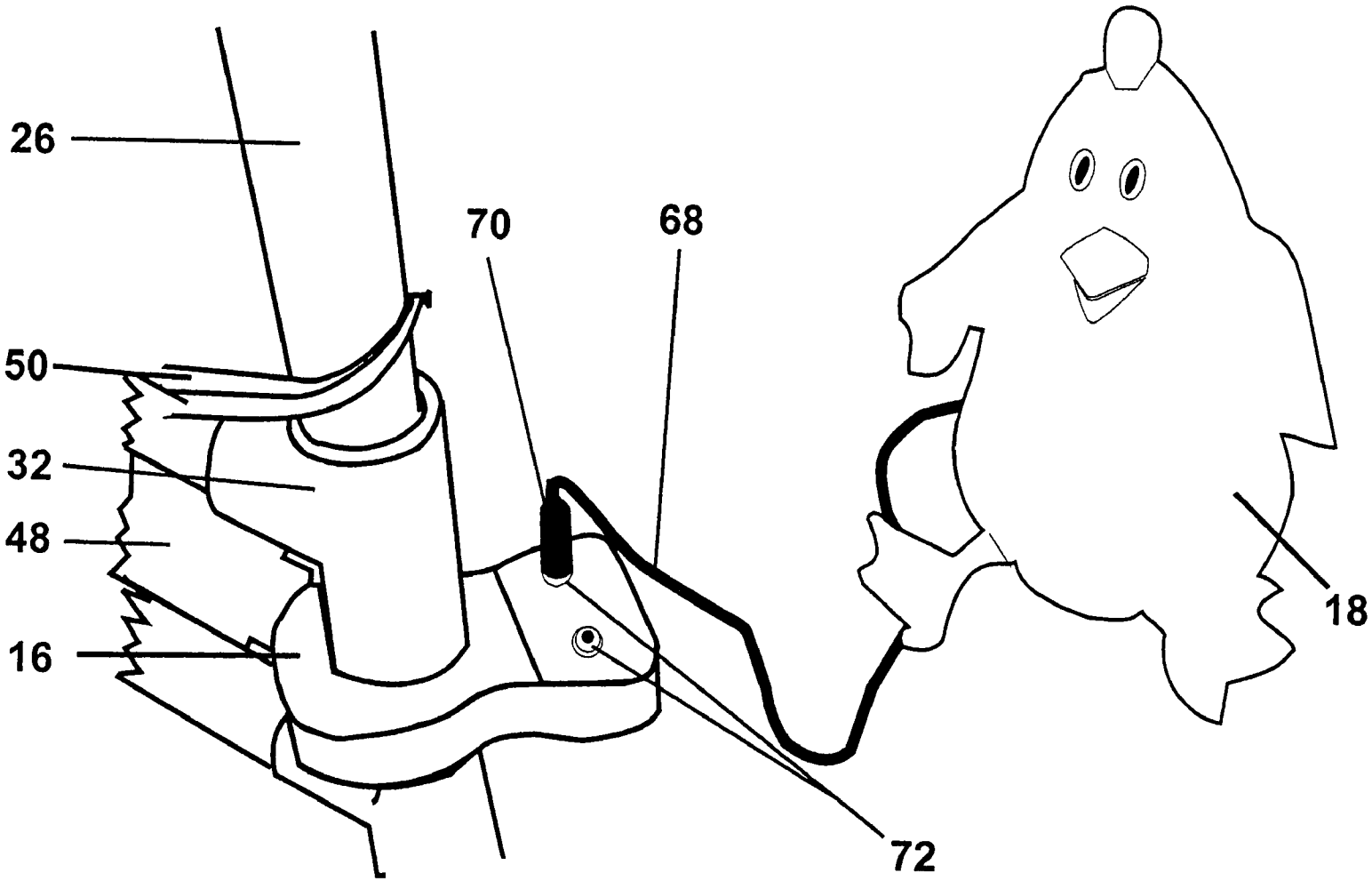
FIG. 4 is a plane view of the switch operatively connected to a device according to the present invention.

FIG. 4 shows the switch 16 electrically connected to device 18. In this embodiment, the switch 16 is electrically connected to the device 18. However, wireless communication devices may be used. For example, an RF device for sending and receiving signals may be used.

In the embodiment shown in FIG. 4, the device 18 is an electronically activated stuffed toy chicken that may be activated by the switch 16. For example if the toy chicken is designed to move when activated, the user will be able to activate the switch lever 14, which in turn, activates the switch 16, thereby activating the toy chicken.

In another embodiment, the device 18 is a remote controller for a television. For example, the user is able to activate the on-off button with the switch lever 14 and the recall button with another lever 14. In that way, the user, who may be physically challenged, may be able to activate one of the switch levers 14 to turn on the television, and another switch lever 14 to change the channel of the television, and thereafter turn off the television. The caregiver may increase the tension required to move the switch lever 14 and/or range of motion required to activate the switch 16, thereby encouraging the user to use more strength and/or motion to activate the device 18. This provides an incentive for the user to increase their strength and movement.

In still another embodiment of the invention, the device 18 is a remote radio controller. For example, the user is able to activate the on-off button with one switch lever 14. In that way, the user, who may be physically challenged, may be able to activate one of the switch levers 14 to turn on the radio, and thereafter turn off the radio.

In addition to these embodiments, it is within the concept of this invention to connect the switch lever system 10 to a wide range of devices 18. In all embodiments, the caregiver may relocate the switch levers 14, increase the tension required to move the switch lever 14 and/or range of motion required to activate the switch 16, thereby encouraging the user to use more strength and/or motion to activate the device 18. This provides an incentive for the user to increase their strength and movement.

The frame 12 is easily assembled and disassembled for storage and transport. The lightweight frame 12 and ease in assembly/disassembly make the switch lever system 10 very mobile. For example, the switch lever system 10 described above will breakdown into a compact area or bundle of approximately 2.5 feet long by 10 inches in diameter.

Modifications and substitutions by one of ordinary skill in the art are considered to be within the scope of the present invention, which is not to be limited except by the following claims.

What is claimed is:

1. A system for assisting physically challenged users in operating at least one device, the system comprising:

a frame;

at least one user operable switch lever having a generally large activation region, operable between a first position and a second position and operatively mounted to the frame;

at least one switch operatively connected to said at least one user operable switch lever, and for energizing the at least one device;

at least one tensioning device, coupled to said at least one user operable switch lever, for applying tension in a first direction to the at least one switch lever, and for holding the at least one switch lever under tension in said first position but allowing the at least one switch lever to be moved by the user into said second position to energize the at least one device upon the user applying a force to the at least one switch lever in a direction opposite said first direction of the tension and with a force that exceeds the tension applied by the tensioning device and for returning the at least one switch lever to the first position; and a switch lever range adjuster, for adjusting the at least one switch lever's range of motion between the first position and the second position.

2. The system according to claim 1, wherein the at least one switch lever is rotatably mounted to the frame.

3. The system according to claim 2, further including means for operatively connecting the at least one switch to the at least one device.

4. The system according to claim 3, wherein the at least one switch lever is movably mounted on the frame.

5. The system according to claim 4, wherein the means for operatively connecting the at least one switch to the at least one device is a wire.

6. The system according to claim 4, wherein the means for operatively connecting the at least one switch to the at least one device is an RF device.

7. The system according to claim 6, wherein the at least one tensioning device is adjustable to adjust the tension required to move the at least one switch lever from the first position to the second position is adjustable.

8. The system according to claim 7, wherein the frame is positioned proximate at least three sides of the user.

9. The system according to claim 8, wherein the tensioning device is a rubber band.

10. The system according to claim 8, wherein the tensioning device is a spring.

11. The system according to claim 8, wherein the at least one switch is mounted to the frame proximate at least one of the user's extremities.

12. The system according to claim 11, wherein the at least one device is a television.

13. The system according to claim 11, wherein the at least one device is a radio.

14. The system according to claim 11, wherein the at least one device is a remote controller for a television.

15. The system according to claim 11, wherein the at least one device is a remote controller for a radio.

16. The system according to claim 11, wherein the at least one device is a toy.

17. The system according to claim 11, wherein the at least one device is a buzzer.

18. The system according to claim 11, wherein the at least one device is a fan.

19. A system for assisting physically challenged users in operating at least one device, the system comprising:

a frame having an extent and sized to be disposed proximate at least three regions of said physically challenged user and to which may be selectively mounted at least one user operable switch lever;

at least one switch lever rotatably mounted to the frame, the at least one switch lever movably mounted to one or more positions on the frame, and wherein said at least one switch has a range of motion that is adjustable;

at least one switch operatively connected to the at least one switch lever;

at least one communication device operatively connected between the at least one switch and the at least one device, and for activating the at least one device when the at least one switch is activated by the at least one switch lever;

at least one tensioning member coupled to said at least one switch lever and operatively connected between the frame and the at least one switch lever, for applying tension in a first direction to the at least one switch lever, and for holding the at least one switch lever under tension in said first position but allowing the at least one switch lever to be moved by the user into a second position to energize the at least one device upon the user applying a force to the at least one switch lever in a direction opposite said first position of the tension and with a force that exceeds the tension applied by the tension member; and wherein the tension member causes the at least one switch lever to return to the first position when the user does not exert sufficient force to overcome the tension applied by the tension member.

20. The system according to claim 19, wherein the tension required to move the at least one switch lever from the first position to the second position is adjustable.

* * * * *